United States Patent [19]

Gallo, Jr.

[11] Patent Number: 4,474,563

[45] Date of Patent: Oct. 2, 1984

[54] TOP END FLAP SEALER

[75] Inventor: Eugene M. Gallo, Jr., Fulton, N.Y.

[73] Assignee: Owens-Illinois, Inc., Toledo, Ohio

[21] Appl. No.: 330,734

[22] Filed: Dec. 14, 1981

[51] Int. Cl.[3] ..... B31B 1/52

[52] U.S. Cl. ..... 493/141; 493/144; 493/151; 493/168; 493/183

[58] Field of Search ..... 493/141, 144, 168, 167, 493/130, 128, 137, 136, 151, 121, 162, 183

[56] References Cited

U.S. PATENT DOCUMENTS

| | | | |
|---|---|---|---|
| 2,426,115 | 8/1941 | Nydegger | 493/168 X |
| 2,820,403 | 1/1958 | Plough et al. | 493/168 X |
| 2,846,929 | 8/1958 | Hickin | 493/168 X |
| 3,741,084 | 6/1973 | Lindstrom | 493/168 |
| 3,800,681 | 4/1974 | Corderoy | 493/167 |
| 3,913,466 | 10/1975 | Bayer et al. | 493/168 |

FOREIGN PATENT DOCUMENTS

| | | | |
|---|---|---|---|
| 731322 | 6/1955 | United Kingdom | 493/141 |

*Primary Examiner*—James F. Coan

*Attorney, Agent, or Firm*—Gerald T. Welch; Myron E. Click

[57] ABSTRACT

Method and apparatus for sealing top end flaps of cartons into engagement with the inner walls of the cartons comprising a horizontal support plate, a first pair of juxtaposed parallel axes rollers mounted adjacent one end of the plate, a second pair of juxtaposed parallel axes with all the rollers having their axes rollers mounted adjacent the other end of the plate, with all the rollers having their axes lying in a common horizontal plane and means for vertical reciprocating support plate. After glue is applied to the inside of the top end flaps and walls of the carton the rollers are moved into engagement with the end flaps and carton walls to seal them together.

8 Claims, 4 Drawing Figures

FIG. 1
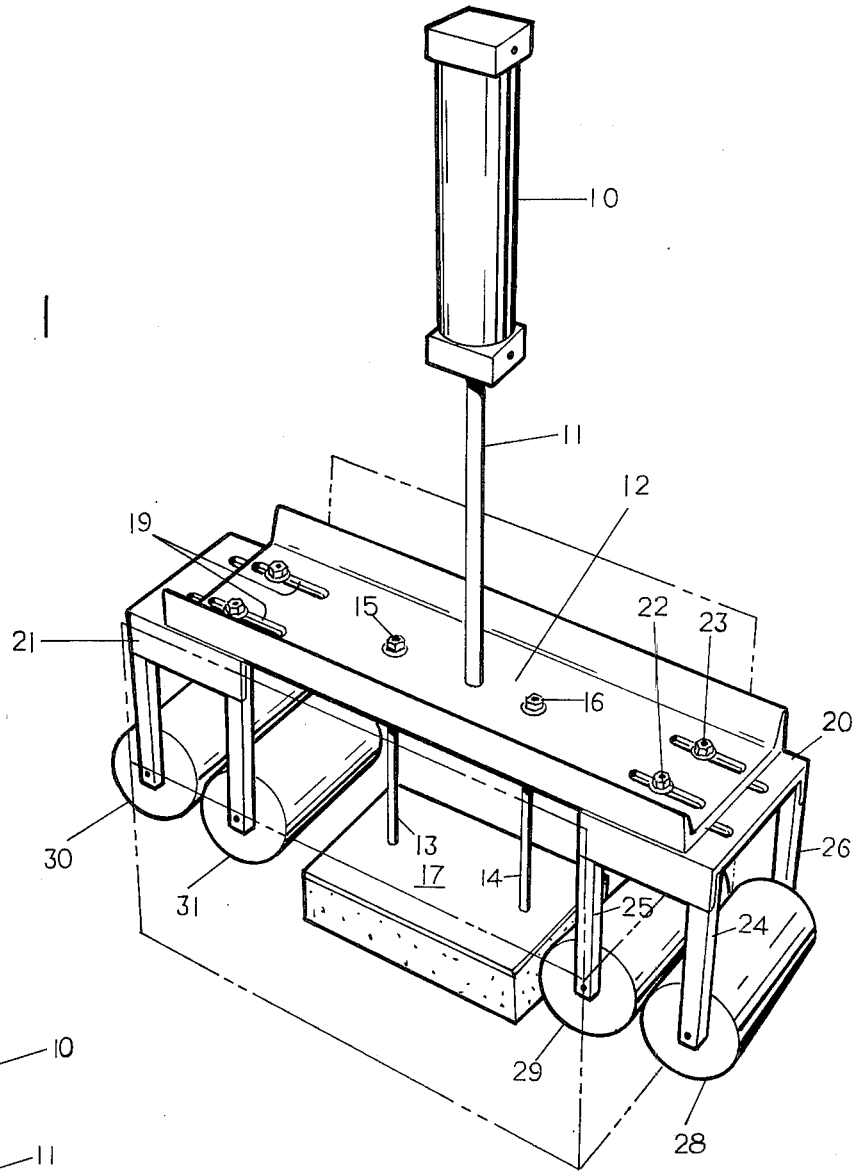
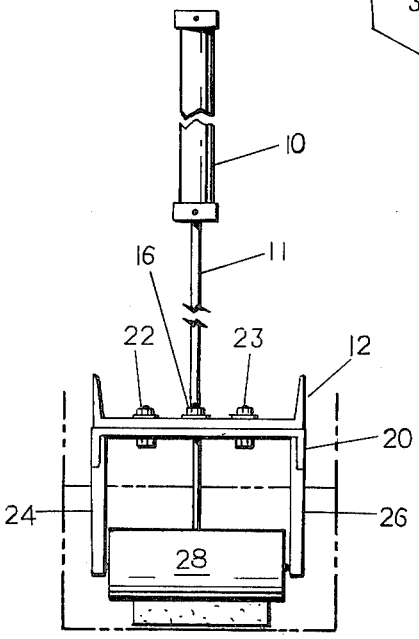
FIG. 2

TOP END FLAP SEALER

BACKGROUND OF THE INVENTION

The art of erecting and sealing cartons which are produced by the cutting of corrugated board into various shapes, depending upon the requirements, is now carried out to a great extent by automatic sealers. These take a flattened carton blank and will fold the side and seal the bottom of the carton, as the carton moves through the sealing unit. In addition, when the carton arrives at the position where the bottom flaps are to be sealed with the inturned end flaps, a pad, carried from above, is moved vertically downward to engage the bottom and end flaps. The pad is to insure that the end flaps are held against the bottom, side flaps that are turned in to effect the completion and sealing of the bottom of the carton.

It should be pointed out that in the sealer made and sold by the ABC Company, as the blank moves through the sealing unit, the appropriate glue is applied to those areas of the carton which are to become sealed. The seal is made when placed in compression by the pressing pad entering through the top of the carton and engaging the closed bottom. The adhesive may be applied in the ABC sealer by rolls or by wheels; however, some glue may be applied to corrugated cartons by using spray heads, which will spray glue onto the flaps or other portions of the carton which are to be subsequently sealed.

Frequently it has become desirable to perform other sealing functions than that provided for by the ABC sealer. It has been the usual practice to perform these additional functions by hand, or on a separate sealing line or machine.

It is an object of this invention to provide apparatus which is used in conjunction with the ABC sealer to provide an automatic system for sealing the top end flaps downwardly and inwardly against the end walls of the carton during the assembly and sealing of the carton on the assembly machine.

It is the further object of this invention to provide apparatus for operating in conjunction with the vertical movement of the sealing pad of an ABC sealer to effect the sealing of the top end flap downwardly and inwardly with respect to the side wall of the carton.

SUMMARY OF THE INVENTION

Method of and apparatus for folding and sealing the top end flap of cartons to the inner wall thereof by applying glue to the inside of the top end flap and the end wall of the carton, moving spaced rollers vertically downward in engagement with the outside end wall of the carton and with the top end flap to effect the sealing together the end to the wall.

BRIEF DESCRIPTION OF DRAWINGS

FIG. 1 is a perspective view of the apparatus of the invention;

FIG. 2 is an end view of the apparatus of FIG. 1;

DETAILED DESCRIPTION OF THE DRAWINGS

Figure 3:
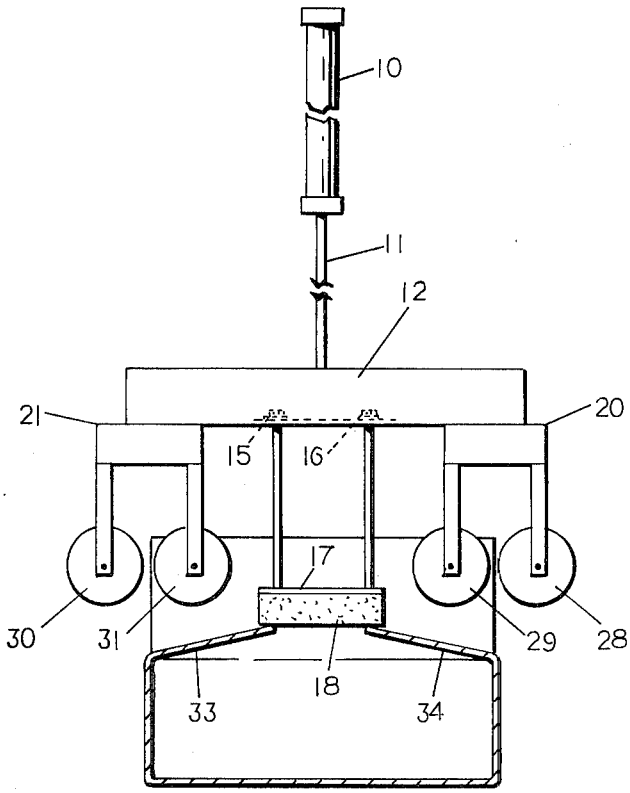
FIG. 3 is a schematic side elevational view of the apparatus of FIG. 1 in its elevated position.

It should be pointed out that existing Art of the Industry requires manually gluing or stapling or pre-processing on specially equipped flexo folder gluers to achieve any sort of non-standard carton set up. Further, the ABC Corporation presently manufactures a bottom sealer unit termed the HMBS-G sealer. This unit is provided with a vertically, reciprocating bottom compression pad which engages the inner bottom of the carton after it has had its bottom flaps folded inwardly, to effect the seal of the bottom of the carton to the flaps. This vertically reciprocating pad mechanism serves as the mounting system of the present invention.

As shown in FIG. 1, a vertical cylinder piston motor 10 has a rod 11 extending downward therefrom. The rod 11 is fixed at its lower end to a channel bracket 12. The bracket 12 is provided with a pair of holes through which a pair of rods 13 and 14 extend. These rods are threaded at their upper ends and receive nuts 15 and 16 thereon. The rods also have clamping nuts 17 and 18 thereon which are positioned beneath the bottom of the channel bracket 12. Thus it can be seen that the two rods 13 and 14 may be vertically adjusted relative to the bracket 12. The lower ends of the rods 13 and 14 support a plate 17. The plate 17 has its lower surface faced with a spongy material 18 such as sponge rubber. The spongy material 18, when in use, serves to compress the inner bottom of the carton to affect the sealing of the bottom of the carton. The channel bracket 12 is provided at each end with horizontal slots 19 therethrough. The slots 19 provide for the adjustable mounting of a pair of plates 20 and 21. The plates 20 and 21 are provided with vertical openings therein which align with the horizontal slots 19. Through these openings are positioned bolts 22 and 23. These bolts 22 and 23 will clamp their respective plates 20 and 21 to the under surface of the bracket 12. The slots 19 provide for horizontal adjustment of the plates 20 and 21 relative to the under surface of the channel bracket 12. This adjustment, as will be clear with regard to the following description, is to accommodate the apparatus for specific cartons.

The plates 20 and 21 each have spaced, downwardly extending members 24 and 25. These members 24 and 25 have complementary members 26 and 27 connected to the underside of the channel bracket by the plate 20 to in effect, provide spaced apart downwardly extending arms. Members 24 and 26 provide the mounting for a horizontal roller 28. Likewise the arms, or members 25 and 27 provide the support for a roller 29. Rollers 28 and 29 are positioned relative to each other such that their periphery is spaced apart slightly less than the double thickness of the corrugated end flap which is to be sandwiched between the two rollers 28 and 29. Another pair of rollers 30 and 31 are similarly mounted to plate 21.

Figure 4:
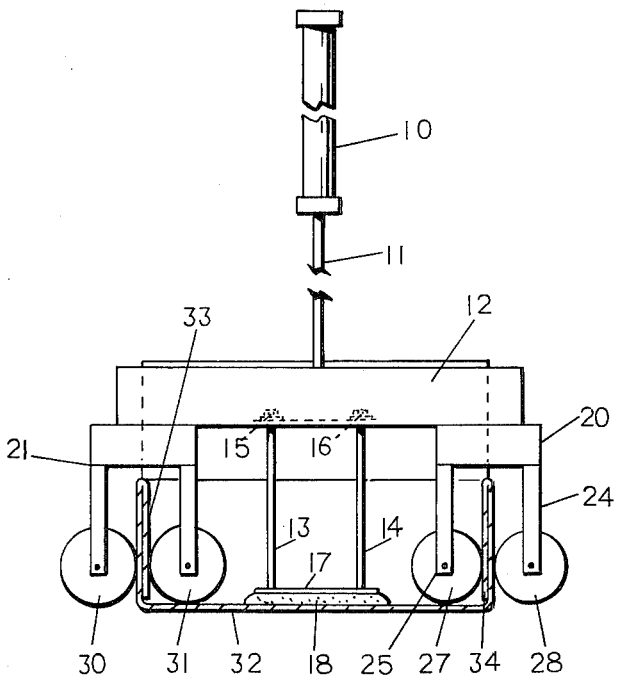
FIG. 4 is a schematic side elevational view of the apparatus of FIG. 1 in its depressed position.

With particular reference to FIGS. 3 and 4, and as was previously explained, the pad 18 during its normal operation is moved downwardly into the interior of the carton whose bottom is to be sealed. It can be seen that upon the lowering of the bracket 12 with the pad 18 mounted therebelow, that the positioning of a carton 32 with its end flaps 33 and 34 extending inwardly, as shown in FIG. 3, the pad 18 will contact the extended end of the flaps 33 and 34, and move them downwardly toward the interior of the carton 32. The continued downward movement of the bracket 12 will carry the rollers 28, 29, 30 and 31 downward such that the roller 28 will engage the end of the carton, and the roller 29 will engage the top end of flap in a like manner. The rollers 30 and 31 will engage the opposite end of the carton and the other top end flap 33 to roll along and to compress these top end flaps against the interior of the ends of the cartons.

Prior to the location of the carton in the position shown in FIG. 3, a required quantity of glue will have been applied to the top end flap interior and/or the interior of the end of the carton to effect the gluing of the top end flap to the interior end of the carton. The particular arrangement described for positioning the flaps interior to the ends of the carton and to glue them in place, provides a carton which has strong ends. In those situations where, for example, the carton might be a beer carton, hand holes may be provided through the top end flap which is folded and, therefore, provide a double thickness hand hold at either end of the carton. Obviously, the carton top is not sealed until after the product has been placed therein, usually with separators of a honeycomb type, separating the glass containers from each other to prevent damage through breakage where there is glass-to-glass contact. The empty glass containers, however, are normally shipped to the brewery in the cartons, termed reshippers.

With the foregoing in view, it can be seen that the apparatus of the invention provides an arrangement for gluing the top end flaps down into engagement with the inner walls of the end of the cartons without the requirement of additional mechanisms for assembling and handling, since the rollers of the invention are mounted to that structure of the ABC sealer which reciprocates the bottom sealing pad. Other and further modifications may be resorted to within the spirit and scope of the appending claims.

I claim:

1. Apparatus for sealing top end flaps of cartons into engagement with the inner walls of the cartons comprising a horizontal support plate, a first pair of juxtaposed, parallel axes rollers, a second pair of juxtaposed parallel axes rollers; means mounting said first pair of rollers in depending fashion adjacent one end of said support plate; means mounting said second pair of rollers in depending fashion adjacent the other end of said support plate; all of said rollers having their axes lying in a common horizontal plane and means for vertically reciprocating said support plate to thereby move said rollers vertically.

2. The apparatus of claim 1 wherein said means mounting said rollers comprises a flat plate, four depending, roller end supporting members connected to said flat plate; and means for attaching said flat plate to the underneath of said horizontal plate.

3. The apparatus of claim 2 wherein said means for attaching said plates is adjustable to provide the roller pairs at different distances from the ends of the horizontal plate.

4. The apparatus of claim 1 further including a rectangular pad; and means carried by said pad for attaching said pad in depending fashion from said support plate intermediate said roller pairs.

5. The apparatus of claim 4 wherein said pad is formed with a resilient foam lower surface.

6. The apparatus of claim 5 wherein said pad has its lower surface positioned below the level of the bottom of the rollers, whereby upon reciprocation of said plate the pad will contact the carton bottom as the rollers fold the top end flaps into sealing engagement

7. The method of folding and sealing top end flaps of cartons to the inner end wall thereof comprising the steps of applying glue to the inside of the top end flap and the end wall of the carton, moving a first pair of parallel spaced rollers, vertically downward into engagement with the outside of one end wall of the carton and the folded-in top end flap to thereby effect the sealing together of the flap and end wall.

8. The method of claim 7 further including the step of moving a second pair of parallel spaced-apart rollers, vertically downward into engagement with the outside of the other end wall of the carton and the folded-in top end flap, simultaneously with the moving of the first pair of rollers, whereby both end flaps are sealed into engagement with the internal end wall of the carton.

* * * * *